United States Patent [19]

Martin, Sr.

[11] Patent Number: 4,665,806

[45] Date of Patent: May 19, 1987

[54] VENTILATING AIR DISTRIBUTOR

[76] Inventor: Lendell Martin, Sr., P.O. Box 344, Mt. Enterprise, Tex. 75681

[21] Appl. No.: 775,432

[22] Filed: Sep. 12, 1985

[51] Int. Cl.[4] ..... F24F 13/10

[52] U.S. Cl. ..... 98/40.12; 98/40.23; 98/41.2

[58] Field of Search ..... 98/40.12, 40.13, 40.23, 98/41.2, 101, 103, 108

[56] References Cited

U.S. PATENT DOCUMENTS

| | | | |
|---|---|---|---|
| 2,125,454 | 8/1938 | Marshall | 98/40.13 |
| 2,367,104 | 1/1945 | Demuth . | |
| 2,433,981 | 1/1948 | Buck . | |
| 2,504,472 | 4/1950 | Van Alsburg et al. . | |
| 3,033,097 | 5/1962 | Phillips . | |
| 3,053,164 | 9/1962 | Lyttle et al. | 98/40.13 |
| 3,103,869 | 9/1963 | Dry . | |
| 3,391,629 | 7/1968 | Snell | 98/103 |
| 4,060,024 | 11/1977 | Deck | 98/40.12 |
| 4,182,227 | 1/1980 | Roy . | |

FOREIGN PATENT DOCUMENTS

| | | | |
|---|---|---|---|
| 867596 | 5/1961 | United Kingdom | 98/101 |
| 1003068 | 9/1965 | United Kingdom | 98/40.23 |

*Primary Examiner*—Harold Joyce

*Attorney, Agent, or Firm*—Pravel, Gambrell, Hewitt & Kimball

[57] ABSTRACT

An air distributor for mounting in a duct outlet in an air conditioning heating and ventilation system is provided to direct the flow of air within the conditioned space. A frame is mounted within the conditioned space and in fluid communication with the outlet of the duct. The frame has an opening therethrough. A deflection member is movably mounted to the frame from an open position wherein the air can flow into the conditioned space to a closed position where essentially no air flows into the conditioned space. The deflection member is selectively adjustable in intermediate positions between the open and closed positions. A diverter is provided with the deflection member and is accessible for adjustment from the conditioned space to selectively direct the air flow between the frame and deflection member into the conditioned space in a two way, three way and four way pattern.

8 Claims, 6 Drawing Figures

VENTILATING AIR DISTRIBUTOR

FIELD OF THE INVENTION

This invention relates to the field of fixtures mounted in a conditioned space which control distribution and direction of the air flow within the conditioned space.

BACKGROUND OF THE INVENTION

In the usual systems used for distributing either warm or cool air from a blower into a room, a series of ducts extend from a main duct and terminate in the ceiling of individual rooms. It is the usual practice to connect one or more fixed opening air outlets to the branch ducts to divert into the branch ducts by means of dampers in the main duct an amount of air required by the outlets attached to the branch ducts.

These dampers create turbulence in the ducts and render the system less efficient. The air impinging on these dampers often causes air noises and rattles which are obnoxious. Further the dampers cannot be readily adjusted if they are incorrectly set on installation. Another difficulty is that sometimes the necessary dampers are omitted entirely during installation of the system and it is an expensive procedure to install them at a later date. A substitute for such dampers is to provide the needed dampening controls at the outlet to each room.

Difficulty is also encountered in controlling air flow along walls or other surfaces through which the undesirable heat transfer is occurring. In order to blanket these walls with conditioned air, the air being supplied to the room must lose perceptible velocity as it reaches the wall in order, to prevent objectionable drafts. This requires a fine control of velocity of the air and is almost impossible to attain unless the air velocity can be adjusted after installation is made. Since the proximity of the outlet in the room to adjacent walls or other surfaces through which heat transfer is occurring is, to some extent, dependent upon the installation contractor, it is desirable to be able to control air velocity at the outlet and in all directions from the outlet.

It is also desirable to independently adjust the total volume of air flowing through an outlet as well as the amount of air flowing in one of four directions emanating from the outlet and disposed at substantially ninety degree angles to each other. Apart from these features, it is also desirable to present within the conditioned space a distributor that has a simple and attractive appearance so as to avoid undue attention to the distributor from the occupants in the space.

DESCRIPTION OF THE PRIOR ART

Ventilation diffusers of the prior art control the distribution of air in all directions from the diffuser combined with some adjustment of the directional flow of air. Typical of such diffusers are those disclosed in U.S. Pat. No. 4,182,227 and 2,367,104. U.S. Pat. No. 2,504,472 added the feature of directional control of air flow but uses complex mechanisms involving springs and horizontal movement of a deflector plate. The air distribution of U.S. Pat. No. 3,033,097 allows for control of air flow in four directions displaced from each other at ninety degrees but provides for individually mounted deflectors that adjust by pivotal motion without a method to insure that the deflectors retain their present position with time. These distributors, due to the clearance between each of the four deflectors required to allow each of them to pivot, did not effectively seal the air flow in a particular direction and were prone to be pushed out of adjustment with time due to the circulating air flow. Yet other designs involved deflectors in combination with dampers but placed the entire assembly in view within the conditioned space thereby presenting a distributor that was not esthetically pleasing. Typical of such distributors is that shown in U.S. Pat. No. 2,433,981. In U.S. Pat. No. 2,433,981, the dampers are positioned between the ceiling and the deflectors. U.S. Pat. No. 3,103,869 is illustrative of some of the methods to allow a diffuser to be maintained in one of several preselected positions. U.S. Pat. No. 4,060,024 discloses a damper assembly consisting of moldable plastic blades mounted for rotation to control air flow.

SUMMARY OF THE INVENTION

An air distributor for mounting in a duct outlet in an air conditioning heating and ventilation system is provided to direct the flow of air within the conditioned space. A frame is mounted within the conditioned space and in fluid communication with the outlet of the duct. The frame has an opening therethrough. A deflection member is movably mounted to the frame from an open position wherein the air can flow into the conditioned space to a closed position where essentially no air flows into the conditioned space. The deflection member is selectively adjustable in intermediate positions between the open and closed positions. A diverter is provided with the deflection member and is accessible for adjustment from the conditioned space to selectively direct the air flow between the frame and deflection member into the conditioned space in a two way, three way and four way pattern.

DESCRIPTION OF THE PREFERRED EMBODIMENT

Figure 1:
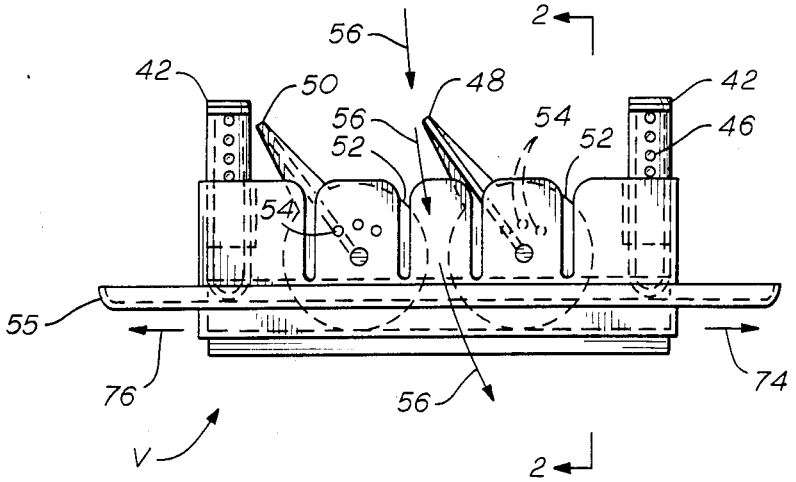
FIG. 1 illustrates a distributor or diffuser suitable for mounting in a vertical wall or furdown.
Figure 2:
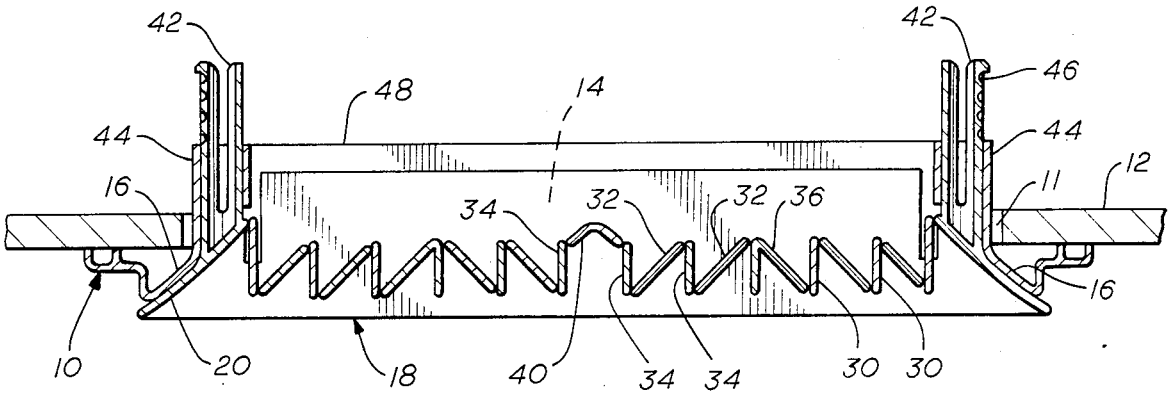
FIG. 2 is a sectional view taken along lines 2—2 of FIG. 1 showing the deflection member in the closed position.
Figure 3:
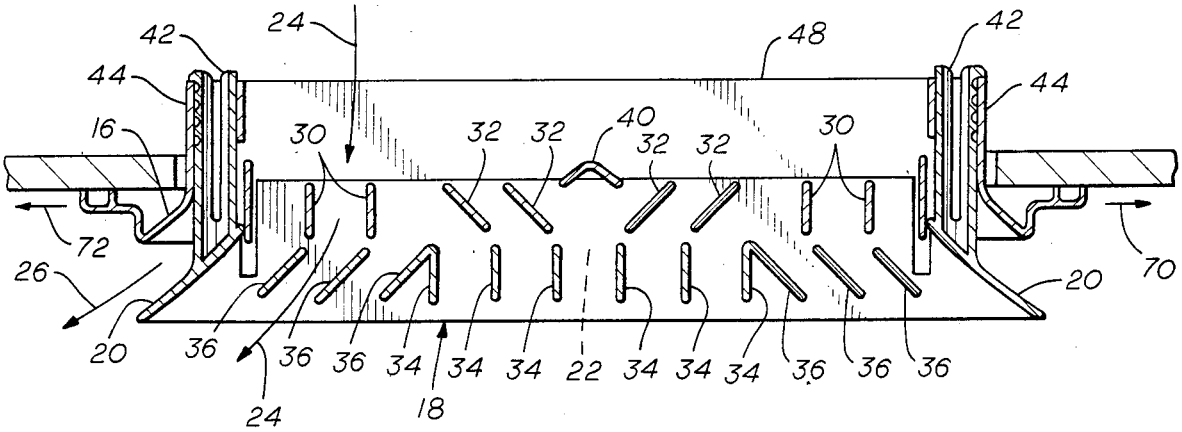
FIG. 3 is a sectional view taken along line 2—2 of FIG. 1 with the deflection member in the open position.

Referring to FIGS. 1-3 the ventilating air distributor V of the present invention is illustrated in the embodiment preferred for wall or furdown installation. As shown in FIG. 2, a frame 10 is fixedly connected to an opening 11 in ceiling or wall 12. Frame 10 has a central opening 14 and is connected to the end of branch duct or outlet box in a ventilation system (not shown). Generally, frame 10 preferably has a rectangular shape with the dimensions predetermined by the air volume that is designed to flow through the distributor V. Central opening 14 is skirted at the lower end of frame 10 by inclined surfaces 16.

Ventilation air distributor V further includes a deflection member 18 which is operably mounted to frame 10 for movement between the closed position illustrated in FIG. 2 and the opened position illustrated in FIG. 3. Deflection member 18 has a frusto-pyramidical shape as defined by inclined surfaces 20. As seen in FIG. 3, deflection member 18 has a central opening 22 which is aligned with central opening 14 of frame 10. When the deflection member 18 is placed in the open position (FIG. 3) the bulk of the air flow as indicated by arrows 24 flows through the aligned central openings 14 and 22. A small portion of the air flow can also pass between deflection member 18 and frame 10 as shown by arrow 26. This flow only occurs in directions 70 and 72 (FIG. 3) and not in directions 74 and 76 (FIG. 1). As seen in FIG. 3, when the deflection member 18 is in the open position, inclined surface 16 is separated from inclined surfaces 20 thereby providing a flow path for the air therebetween. Surfaces 16 and surfaces 20 are disposed in parallel planes whereupon when deflection member 18 is placed in the closed position (FIG. 2) surfaces 16 and 20 are placed in aligned contact thereby substantially preventing airflow therebetween.

As best seen in FIG. 3, central opening 14 in frame 10 is spanned by baffles 30 and 32 which connect to opposing sides of the frame 10. Preferably, baffles 30 and 32 are elongated, flat bar elements. As seen in FIG. 3, baffles 30 disposed adjacent opposing ends of opening 14 are aligned substantially parallel to the direction of air flow entering ventilation air distributor V as shown by arrow 24, which direction is perpendicular to wall 12. Baffles 32 are disposed at an inclined angle to baffles 30. As seen in FIG. 3 baffles 32 are mounted toward the center of central opening 14.

Deflection member 18 has the inverse pattern of baffles as compared to those connected to frame 10. Specifically, baffles 34 are disposed adjacent the center of opening 22 in deflection member 18 and are aligned in a direction parallel to the air flow entering ventilation air distributor V as shown by arrow 24. Similarly, baffles 36 as disposed at an inclined angle with respect to baffles 34. The baffles 30 and 32 in frame 10 are offset from the baffles 34 and 36 in deflection member 18 thereby allowing deflection member 18 to move from the open position (FIG. 3) to the closed position (FIG. 2). The upper end of surfaces 20 are notched (not shown) to allow deflection member 18 to pass beyond baffles 30 and 32. As seen in FIG. 2, when deflection member 18 is placed in the closed position, baffles 34 and 36 have been moved up to the same level as baffles 30 and 32 and are nested in the air paths between baffles 30 and 32. Additionally, a baffle 40 is centrally disposed on frame 10 in opening 14 such that placement of deflection member 18 in the closed position places baffle 40 between adjacent baffles 34 thereby effectively blocking central openings 14 and 22 and reducing the air flow through ventilation air distributor V to a small imperceptible flow.

As seen in FIGS. 2 and 3, deflection member 18 can be adjusted in one of several positions between the closed position of FIG. 2 and the fully opened position of FIG. 3. In order to secure deflection member 18 in a preselected position, four adjustment posts 42 extend from deflection member 18 into ventilation air distributor V. The frame 10 has a corresponding number of tubular adjustment members 44 which are extensions of inclined surfaces 16 and adapted to encircle adjustment posts 42. Adjustment posts 42 each have a series of aligned depressions 46. Aligned depressions 46 are adapted to selectively engage a projection or stud (not shown) within tubular adjustment members 44 thereby allowing movable deflection member 18 to be positioned at differing spaced relationships to frame 10 when controlling the total amount of air flow through ventilation air distributor V.

The ventilation air distributor V of the type shown in FIGS. 1–3 is typically installed in a wall adjacent the ceiling in a conditioned space such that the longitudinal axis of baffles 30, 32, 34, and 36 are in a plane parallel to the wall. On certain occasions, it may be desirable to direct the air emerging from ventilation air distributor V either straight out of the distributor V or downwardly away from the ceiling and into the conditioned space. To accomplish this diversion of air, dampers 48 and 50 are pivotally mounted to the frame 10 with their longitudinal axis in a plane perpendicular to the longitudinal axis of baffles 30, 32, 34, and 36 (FIGS. 2 and 3). Each of dampers 48 and 50 include a flat bar or blade having attached or integrally formed at each end an integral thumb wheel 52 accessible through a slot in the deflection member 18 from the conditioned space for selectively setting dampers 48 and 50 as desired. In order to secure dampers 48 and 50 in a preselected position, thumb wheel 52 has a series of depressions 54 which engage a projection (not shown) on frame 10 to retain the position of dampers 48 and 50 in the preselected positions (see FIG. 1). Thumb wheels 52 remain accessible from the conditioned space when the deflection member 18 is in the open position (FIG. 3) as well as in the closed position (FIG. 2). The interplay between dampers 48 and 50 and baffles 30, 32, 34, and 36 can be seen from a comparison of FIGS. 1 and 3. For example, should it be desirable to orient the air flow out of ventilation air distributor V towards the floor in the space, dampers 48 and 50 can be set in the position as shown in FIG. 1 with the understanding that end 55 is disposed nearest the ceiling in the conditioned space. With dampers 48 and 50 in the position illustrated in FIG. 1, the air flow through ventilation air distributor V will be along the paths illustrated by arrows 56. It is more advantageous to use a pair of dampers rather than one large damper to divert the air toward the floor in the conditioned space since with the use of two dampers 48 and 50 a larger portion of the face area of ventilation air distributor V remains available for air flow even when dampers 48 and 50 are set in an extreme position. With the use of one centrally mounted damper, there exists a potential for half the face area of the ventilation air distributor V to be blocked off when the damper is placed in an extreme position to divert the air toward the floor in the conditioned space.

In order to ease the adjustment of deflection member 18, inclined surfaces 20 extend beyond inclined surfaces 16 so that when deflection member 18 is in the closed position (FIG. 2) the edges of inclined surfaces 20 can be easily gripped to pull the deflection member 18 outwardly away from the wall and toward its opened position.

Figure 4:
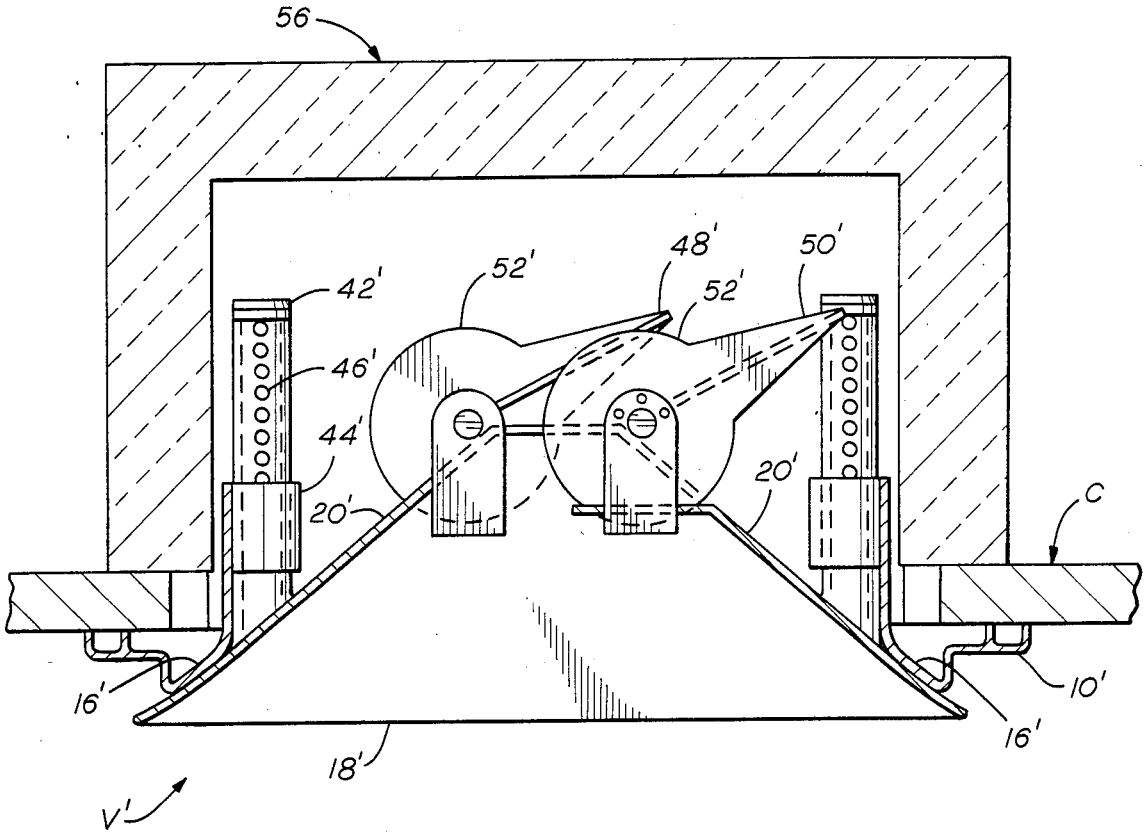
FIG. 4 is a sectional elevational view of a distributor or diffuser suitable for ceiling mounting.
Figure 5:
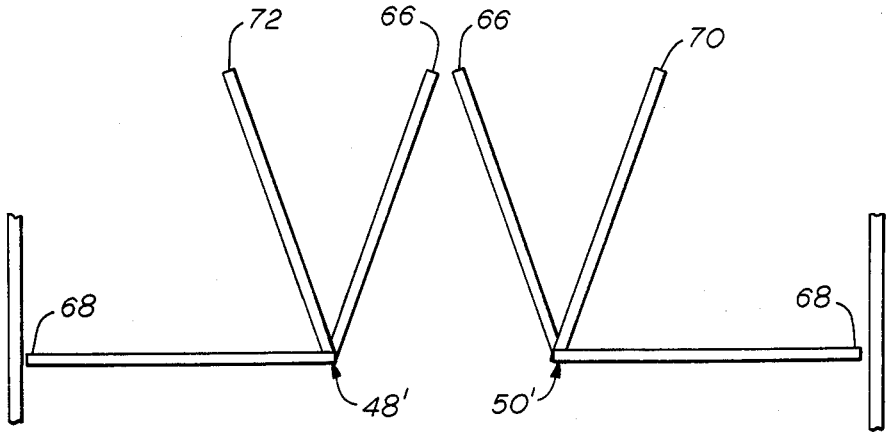
FIG. 5 is a schematic elevational view of several possible combinations of damper positions obtainable with the dampers also illustrated in FIG. 4.
Figure 6:
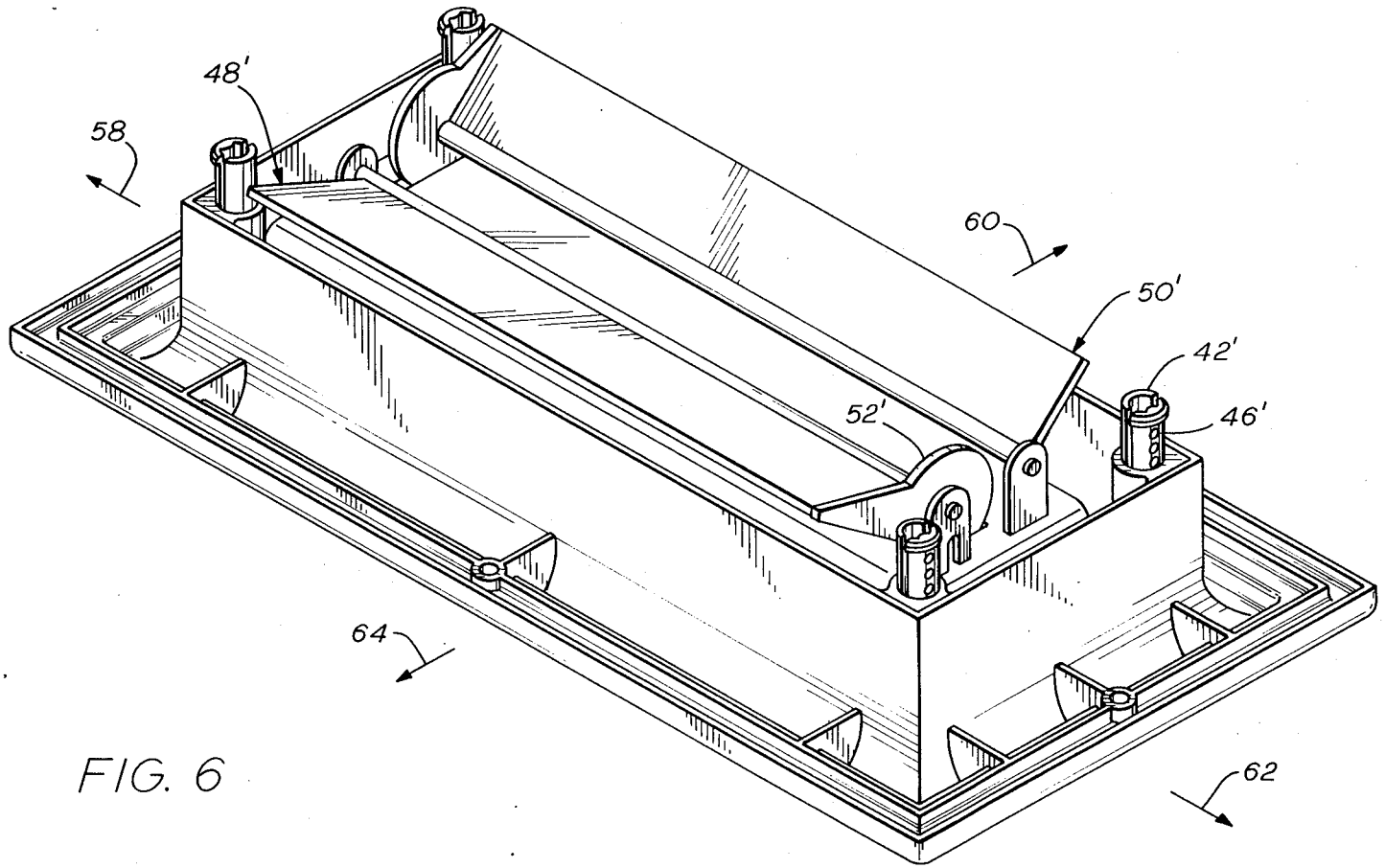
FIG. 6 is a perspective view of the diffuser of FIGS. 4 and 5 suitable for ceiling mounting illustrating the components disposed within the branch duct.

Referring to FIGS. 4 through 6 there is shown a ventilation air distributor V′ that is suitable for mounting in a ceiling C of any type of construction. The ventilation air distributor V′ may be installed at the end of a branch duct or an outlet box shown generally as 56. Frame 10′ shown in FIG. 4 is of similar construction to frame 10 shown in FIGS. 1 through 3 and is affixed to the ceiling C. Deflection member 18′ is a frustro-pyramidal shaped member having inclined surfaces 20 that are adapted to engage inclined surfaces 16 on frame 10 when the deflection member 18' is placed in the closed position (FIG. 4). Deflection member 18' may be placed in any one of several intermediate positions between the open and closed position via the interaction of adjustment posts 42' and tubular adjustment members 44'. Just as in the embodiment of FIGS. 1–3, the aligned depressions 46 engage a projection (not shown) within tubular adjustment members 44' to retain deflection member 18' in a preset position. To aid in setting deflection member 18' in a given position, inclined surface 20' is longer than inclined surface 16' thereby allowing the edges of deflection member 18' to be grasped so that it can be pulled downwardly away from the ceiling C to adjust the total air flow flowing through ventilation air distributor V'.

Distinguished from the deflection member 18 of FIGS. 1–3, the deflection member 18' FIGS. 4 through 6 has a closed top with flow diverters 48' and 50' affixed to the deflection member 18' rather than to frame 10'. Flow diverters or dampers 48' and 50' are of the same construction as dampers 48 and 50 of FIGS. 1–3; however, in this embodiment the dampers 48' and 50' perform additional functions. As seen in FIG. 6, when deflection member 18' is pulled downwardly away from ceiling C, flow through ventilation distributor V' occurs in four directions which are essentially spaced at ninety degrees and indicated by arrows 58, 60, 62, and 64. As seen in FIG. 4 the air emerges from ventilation air distributor V' in directions 58, 60, 62, and 64 by passing between inclined surfaces 16' and 20'.

To accommodate the specific requirements of a given installation, it may be desirable to restrict the air flow to three of the four directions depicted in FIG. 6 or two of the four directions depicted in FIG. 6. Accordingly, when deflection member 18' pulled down toward the open position, dampers 48' and 50' can be placed in various positions to accomplish four way flow (in directions 58, 60, 62 and 64), three way flow (directions 58, 60 and 62 or 58, 62 and 64), or two way flow (directions 58 and 62). Referring to FIG. 5, four way flow will result when dampers 48' and 50' are placed in the position marked 66. Two way flow in directions 58 and 62 will occur when dampers 48' and 50' are placed in position 68. Three way flow in directions 58, 60 and 62 will occur when damper 48' is left in position 68 and damper 50 is raised to position 70. Alternatively, three way flow in directions 58, 62 and 64 will occur when damper 50' is placed in position 68 and damper 48' is raised to position 72.

As described in FIGS. 1–3, the dampers 48' and 50' have thumb wheels 52' which are accessible from the conditioned space to adjust dampers 48' and 50'. The same structure is used to retain the position of the dampers 48' and 50' in the embodiment shown in FIGS. 4 to 6 as previously described in the embodiment of FIGS. 1–3.

The ventilation air distributor V as shown in FIGS. 4–6 offers numerous advantages in regulating the total amount of air flow as well as directing the air flow in a four way, three way, or two way pattern depending upon placement of the distributor V' and the proximity of walls or other places wherein heat or cold is absorbed into the conditioned space. The occupants of the conditioned space therefore have the maximum flexibility in directing the total flow of the air as well as the direction at which the air is blown into the room. Furthermore, the ventilation air distributor V' of the present invention offers an inexpensively made design which is esthetically pleasing when installed in the conditioned space. It is understood that the components of ventilation air distributor V' can be produced from metal or plastic materials. When produced in plastic the mold can be etched and color concentrates can be added to the plastics to give the finished product a polished aluminum look.

The foregoing disclosure and description of the invention are illustrative and explanatory thereof, and various changes in the size, shape and materials, as well as in the details of the illustrated construction may be made without departing from the spirit of the invention.

I claim:

1. An air distributor for mounting in a duct outlet to a heating ventilation and air conditioning system to direct the flow of air into a conditioned space comprising:

a frame mounted within the conditioned space and in fluid communication with the outlet of the duct, said frame having an opening therethrough;

plurality of baffles mounted to said frame and spanning said opening and being positioned with air flow spaces between the baffles;

a deflection member having a central opening and a plurality of baffles spanning said central opening and being positioned with air flow spaces between the baffles, mount means mounting said deflection member operably to said frame for movement between an open and closed position;

said deflection member central opening aligned with said opening in said frame, said baffles on said deflection member offset from said baffles on said frame;

whereupon when said deflection member is in said closed position said baffles of said deflection member are nested within said baffles of said frame thereby substantially blocking the air flow into the conditioned space;

when said deflection member is moved toward said open position on said frame, said baffles on said frame and said deflection member channel the air flow through said air flow spaces in said frame and in said deflection member thereby distributing the air into the conditioned space;

said frame opening is defined by an inclined surface; and said deflection member has an inclined surface at substantially the same angle as said inclined surface on said frame whereupon when said deflection member is in said closed position said inclined surfaces of said frame and said deflection member are in aligned contact and the flow of air is substantially interrupted therebetween.

2. The distributor of claim 1 wherein:

said baffles on said frame adjacent opposing ends of said opening in the frame are disposed in alignment with the air flow entering the distributor from the duct and said baffles on said frame mounted centrally in the opening thereof are inclined with respect to said baffles on said frame adjacent opposing ends of the opening thereof;

said baffles on said deflection member centrally disposed in said opening thereon are disposed in alignment with the direction of air flow entering the distributor from the duct and said baffles on said deflection member adjacent the ends of the opening thereon are inclined with respect to said centrally mounted baffles on said deflection member;

whereupon when said deflection member is in said open position air is directed into the conditioned space substantially straight through the distributor in its center and at an angle from the face of the diverter adjacent opposing ends; and when said deflection member is in said closed position the nesting between said baffles on said frame and deflection member substantially blocks the air flow.

3. The distributor of claim 2 whereon:

at least one diverter is disposed upstream of said baffles on said frame and said diverter is adjustable from the conditioned space.

4. The distributor of claim 3 wherein:

the longitudinal axis of said diverter is disposed substantially perpendicularly to the longitudinal axes of said baffles in said frame and said deflection member whereupon when the frame is mounted on a vertical wall adjacent the ceiling in the conditioned space with the longitudinal axis of said baffles aligned with the floor in the conditioned space, said diverter can selectively direct the air exiting the distributor from the ceiling and downwardly toward the occupants of the space.

5. The distributor of claim 4 wherein:

said deflection member has a plurality of adjustment posts;

each said adjustment posts formed having a plurality of aligned depressions thereon;

said frame further including:

a plurality of tubular adjustment members each adapted to accommodate movement of one said adjustment posts, said adjustment members formed having a projection thereon said projection extending into one of said aligned depressions on said adjustment post to secure said deflection member in a preselected orientation from said open to said closed position.

6. The distributor of claim 1 including:

a flow director means including two flow dampers mounted to said frame.

7. The distributor of claim 6 wherein:

each of said flow dampers having at least one integral thumb wheel extending through said deflection member thereby allowing each said flow damper to be individually adjusted from the conditioned space; and each said flow damper is pivotally mounted on opposing ends to said frame.

8. The distributor of claim 1 wherein:

said inclined surfaces of said deflection member extend beyond said inclined surfaces on said frame thereby allowing the edges of said deflection member to be grasped in order to move said deflection member from said closed toward said open position.

* * * * *